US005806531A

United States Patent [19]

Diehl et al.

[11] Patent Number: 5,806,531

[45] Date of Patent: Sep. 15, 1998

[54] METHOD AND APPARATUS FOR AUTOMATIC AND CONTINUOUS PNEUMATIC FEEDING OF TOBACCO

[75] Inventors: Gary A. Diehl, Macon, Ga.; Ronald E. Burdette, Landrum, S.C.

[73] Assignee: Brown & Williamson Tobacco Corporation, Louisville, Ky.

[21] Appl. No.: 766,782

[22] Filed: Dec. 13, 1996

Related U.S. Application Data

[60] Provisional application No. 60/013,374 Mar. 15, 1996.

[51] Int. Cl.[6] ..... A24C 5/39

[52] U.S. Cl. ..... 131/110; 131/108; 131/109.2; 131/84.1

[58] Field of Search ..... 131/110, 108, 131/109.2, 109.1, 84.1, 84.3; 209/906; 406/19; 168/181–183; 198/766

[56] References Cited

U.S. PATENT DOCUMENTS

| | | | |
|---|---|---|---|
| 2,672,871 | 3/1954 | Slovic | 131/110 |
| 4,491,138 | 1/1985 | Labbe | 131/110 |
| 4,534,368 | 8/1985 | Labbe | 131/110 |
| 4,832,058 | 5/1989 | Labbe | 131/110 |
| 4,932,423 | 6/1990 | Lauenstein et al. | 131/110 |
| 5,141,002 | 8/1992 | Jeske et al. | 131/110 |
| 5,322,074 | 6/1994 | Cross, Jr. | 131/110 |

FOREIGN PATENT DOCUMENTS

| | | | |
|---|---|---|---|
| 1556155 | 1/1970 | Germany | 131/110 |
| 2813106 | 9/1979 | Germany | 131/110 |
| 0587958 | 3/1994 | Germany | 131/110 |
| 1397846 | 6/1975 | United Kingdom | 131/110 |
| 2139870 | 11/1984 | United Kingdom | 131/110 |
| 2168885 | 7/1986 | United Kingdom | 131/110 |

*Primary Examiner*—V. Millin
*Assistant Examiner*—Charles W. Anderson
*Attorney, Agent, or Firm*—Charles I. Sherman; Middleton & Reutlinger; John F. Salazar

[57] ABSTRACT

A continuous pneumatic tobacco conveyance system is described which automatically controls the rate at which tobacco is fed into the conveyance system and automatically controls the velocity of the tobacco which is pneumatically conveyed. The system utilizes a plurality of programmable logic controllers for analyzing the velocity of the tobacco in the system and the amount of tobacco required and currently existent in cigarette making machine. The system compensates for correct airflow and velocity of the tobacco in the pneumatic piping by controlling the rate at which tobacco is fed into the conveyance system and controlling the airflow required to move the tobacco at a continuous velocity by adjusting a flow control valve attached to a vacuum source.

22 Claims, 8 Drawing Sheets

METHOD AND APPARATUS FOR AUTOMATIC AND CONTINUOUS PNEUMATIC FEEDING OF TOBACCO

Provisional application 60/013,374 filed Mar. 15, 1996 is now abandoned.

BACKGROUND OF THE INVENTION

1. Field of the Invention

The present invention relates to an apparatus for continuous feeding of material to a manufacturing machine, and more particularly, to the continuous pneumatic feeding of cut tobacco to a cigarette making machine.

2. Discussion of the Prior Art

It is well known in the art to pneumatically convey tobacco from one point to another, especially in conveying tobacco from a bulker or other containment area to a cigarette maker. However, prior art devices have inherent problems with keeping the air-entrained tobacco traveling at a constant speed or likewise preventing the stopping and starting of the pneumatic conveyance system when the cigarette makers have filled their hoppers. Typically, in these prior art systems, the hopper of the maker is filled upon a signal of a low level of tobacco in the maker hopper. When such a low hopper signal is received, a vacuum is instituted in the pneumatic piping in order to convey the tobacco from the bulker to the maker hopper. The vacuum created in the piping is from a single source and at a given pressure. If multiple makers are requesting tobacco for empty hoppers, the velocity of the tobacco within the pneumatic piping can vary greatly as does the pressure within the piping itself. Additionally, once the maker hopper is filled, the vacuum source is discontinued and the tobacco presently being conveyed in the pneumatic piping comes to rest within said piping until the vacuum source is returned after the request for additional tobacco is made by another cigarette maker. The effect of varying velocity of the tobacco in the conveyance pipes or of initiating and discontinuing the pressure in the pipes is detrimental to the tobacco itself and causes dusting of the tobacco thereby reducing the fill value of the tobacco conveyed. Thus, there is a need for an apparatus which provides automatic control of the rate at which tobacco is fed into the pneumatic conveyance system and automatic control of the velocity of the tobacco pneumatically conveyed.

SUMMARY OF THE INVENTION

It is an object of the present invention therefore to overcome the problems set forth above and provide a system which allows the tobacco to be controlled into a pneumatic conveyance system and also controls the velocity at which the tobacco is conveyed within said system.

It is a further object of the present invention to minimize the degradation of tobacco in a pneumatic conveying system.

In furtherance of the above objectives, the present invention comprises a method and apparatus which automatically controls the rate at which tobacco is fed from a bulker into a pneumatic conveyance piping system and which automatically controls the velocity of the tobacco within the pneumatic conveyance piping system.

More particularly, the present invention comprises a method and apparatus for continuous pneumatic conveyance of tobacco from a bulker to a cigarette maker comprising a first flow transmitter in a pneumatic piping conduit at the bulker and another flow transmitter at a cyclone on the maker. The flow transmitters are operatively responsive to a flow control valve to adjust the velocity of the air flowing within the pneumatic piping thereby controlling the velocity of the tobacco being conveyed. Tobacco is fed from a bulker through slide gates into an airlock which disperses the tobacco into an airstream. Programmable logic controllers (PLC's) are utilized to interpret the data from the flow transmitters and adjust the flow control valve to keep the tobacco flowing at a constant velocity. Additionally, PLC's are utilized to interpret data from a level transmitter at the cigarette maker and adjust the slide gate at the bulker so as to control the amount of tobacco fed into the airstream.

Finally, the present invention comprises an apparatus for continuously feeding tobacco from a bulker to at least one cigarette making machine, comprising: a vibratory feed pan affixed to said bulker and disposed beneath a discharge opening of said bulker, said vibratory feed pan having an outlet, said outlet having at least one aperture and a slide gate slidably movable over said aperture; an airlock disposed directly below said slide gate; a cyclone connected to said at least one cigarette making machine, said cigarette making machine having an exit aperture located at one end; pneumatic piping connecting said airlock to said cyclone and further connecting said cyclone to a vacuum source; an ultrasonic level transmitter within said cigarette making machine; and, a controller operably connected to said level transmitter and said slide gate.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
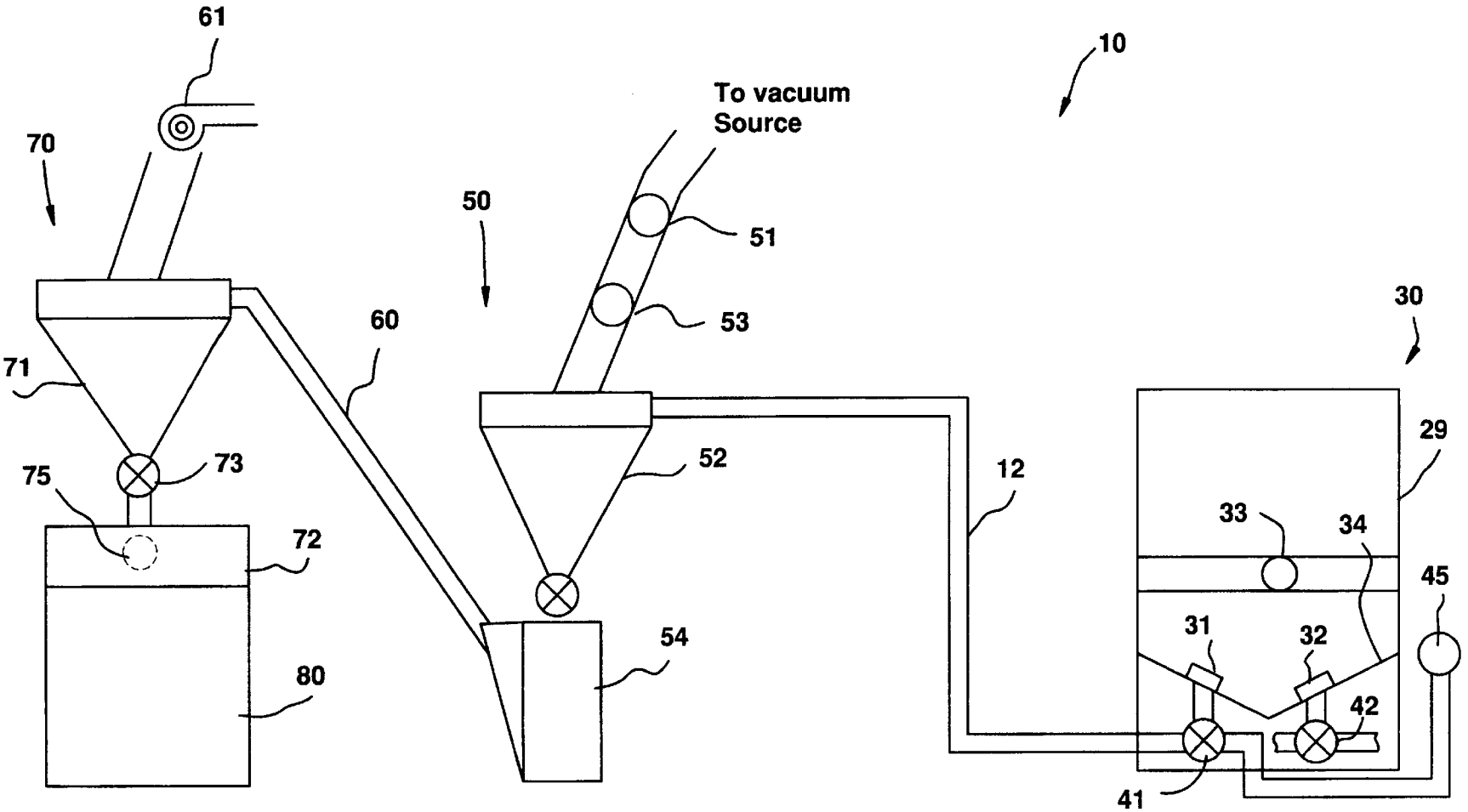
FIG. 1 is a perspective view of the overall system for a tobacco continuous pneumatic conveyance system of the present invention.

The automatic and continuous conveyance system for tobacco of the present invention is shown schematically in FIG. 1 and identified by the numeral 10. The system 10 is comprised of multiple sections. The first section is a feeder section 30 which comprises a bulker 29 and a vibratory feed pan 34 which receives tobacco from the bulker 29 and disperses tobacco and meters the tobacco into a pneumatic air piping 12. Tobacco which is metered out from the bulker 29 is conveyed through piping 12 by a vacuum source into a separation section 50 which comprises a cyclone 52 and a multiaspirator 54. The cyclone 52 is provided to separate the tobacco from the high velocity airstream with minimal damage to the tobacco, the separate tobacco being fed into the multiaspirator 54. The multiaspirator 54 is provided to remove heavier tobacco particles, such as stems, veins and bulbs from the leaf or laminae portion of the tobacco. From the aspirator 54, the light-weight tobacco particles are conveyed to the cigarette making section 70 which is comprised of a cyclone 71 and a cigarette maker 80 which has a tobacco hopper 72 located thereon for storage of tobacco leaf. Hopper 72 receives tobacco from the cyclone 71. The total distance the tobacco can travel from the bulker 29 to the maker hopper 72 may be anywhere from a few meters when the sections are located near one another to several hundred meters when the sections are dispersed throughout a tobacco manufacturing plant. The entire conveyance system 10 shown in FIG. 1 is controlled by a plurality of programmable logic controllers 100, 101 and 102 which continually measure the demand on the system and increases or decreases the air flow within the pneumatic pipes 12 and increases or decreases the amount of tobacco into the system depending on the demand rate of the makers 80.

Figure 2:
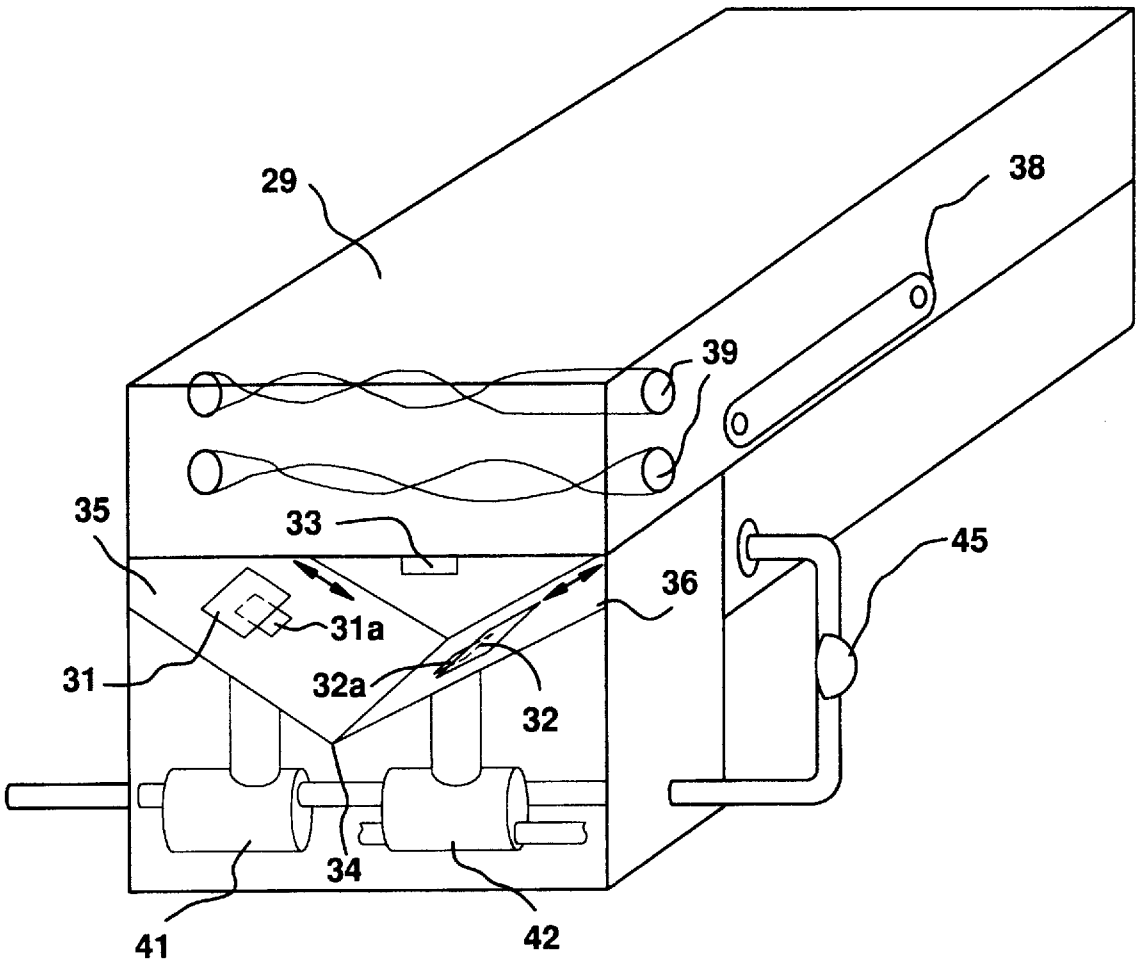
FIG. 2 is perspective view of a feed section of the system shown in FIG. 1.

Shown in FIG. 2 is a perspective view of the feeder section 30 of the present invention which is comprised of a bulker 29 containing cut tobacco which is slowly fed into a vibratory feed pan 34. The bulker 29 may contain various amounts or percentages of various types of tobacco in a tobacco blend, such as, commuted tobacco, cut tobacco, reconstituted tobacco and other various forms of tobacco leaf. As shown in FIG. 2, at the end of the bulker 29 are dofflers 39 which agitate compressed tobacco thereby separating the tobacco which falls in loose form into the vibratory feed pan 34. A belt conveyor 38 is provided along the bottom of the bulker to move the tobacco forward from the rear portion of the bulker bringing it into contact with the dofflers 39. The front end of the bulker 29 has a discharge opening thereby providing means for continuous feeding of tobacco into the feed pan 34.

Above the vibratory feed pan 34 at the front end of bulker 29 is an ultrasonic level transmitter 33, shown in FIG. 1, which measures the depth of the tobacco on the vibratory feed pan 34. Level transmitter 33 is an ultrasonic emitter/detector and measures the depth of tobacco in order to control the speed of conveyor belt 38, as well as stopping or starting belt 38 thereby increasing or decreasing the amount of tobacco in the feed pan 34. The ultrasonic level transmitter 33 ensures the tobacco falls from the bulker 29 into the feed pan 34 at a controlled and steady rate. Other known means for detecting the depth of tobacco in the feed pan known in the art, such as optical means, sensors, and the like, may also be used for measurement of the depth of tobacco in the feed pan 34. The level transmitter 33 determines the rate at which the bulker 29 dispenses cut tobacco into the conveying system and ensures the feed pan 34 is not overwhelmed by falling tobacco from the bulker 29. The measurements read by the transmitter 33 are fed into a programmable logic controller 101 which controls the speed of conveyor belt 38 in the bulker 29 based upon said depth measurement as well as doffler bars 39. An additional conveyor belt is located along the bottom of the bulker 29 (not shown) and is used to advance the tobacco from the rear of the bulker 29 to the open forward section near dofflers 39.

Figure 3:
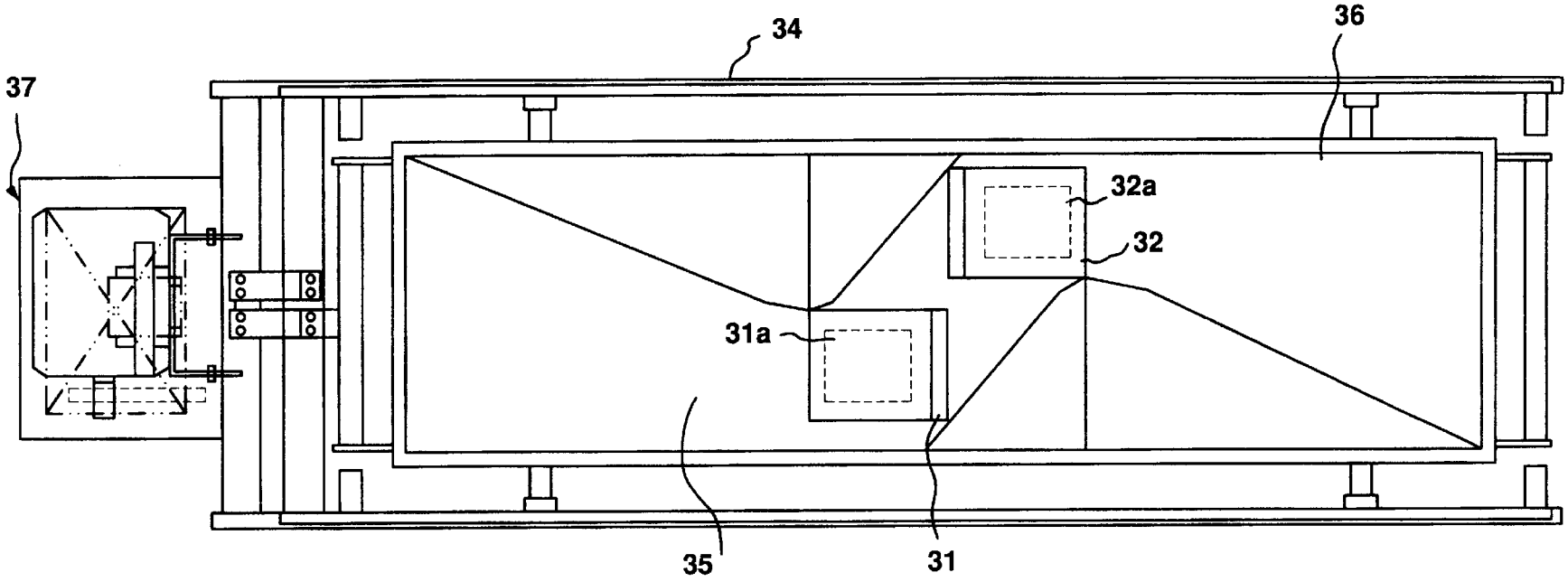
FIG. 3 is a top view of the feed section shown in FIG. 2.
Figure 4:
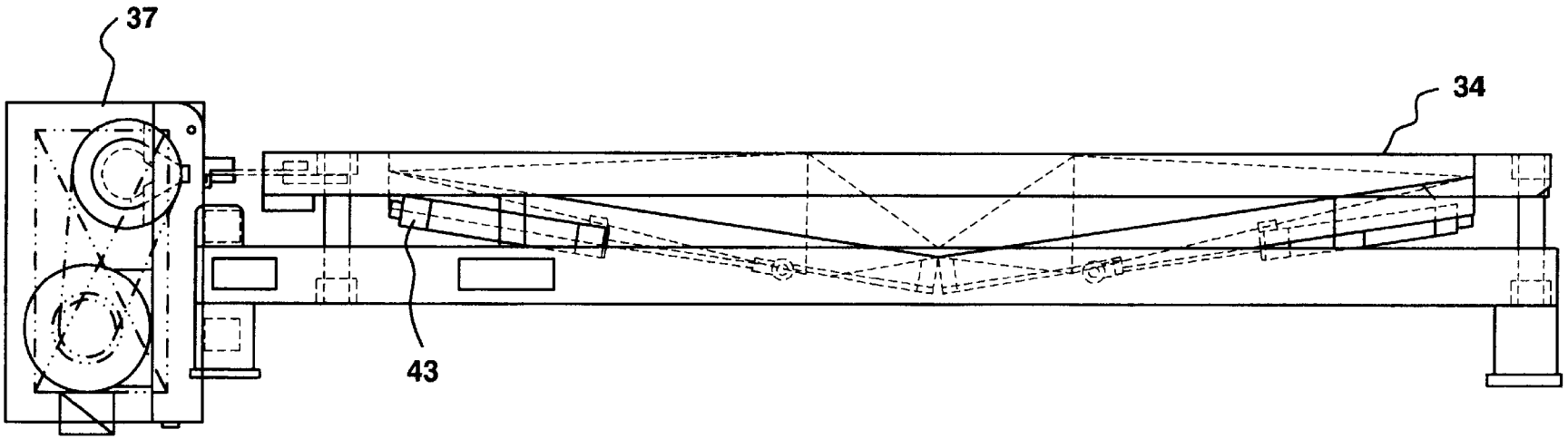
FIG. 4 is a front view of the feed section shown in FIG. 3.

Integral with the vibratory feed pan 34 of the present invention are first and second slide gates 31 and 32. The vibratory feed pan 34 is of a V-shaped configuration with a first and a second sloped surface 35 and 36 as shown in FIGS. 2, 3 and 4. Feed pan 34 is operably connected to vibratory motor 37 which shakes downwardly opposed angled surfaces 35 and 36 to allow tobacco to be fed into apertures 31*a* and 32*a* formed below slide gates 31 and 32, slide gate 31 operably connected to surface 35 and slide gate 32 operably connected to surface 36. Apertures 31*a* and 32*a* feed into separate rotary airlocks 41 and 42, such as those manufactured by KICE Inc. Slide gates 31 and 32 open and close depending upon the amount of tobacco requested by cigarette maker 80 or other makers attached to airlocks 41 and 42. Slide gates 31 and 32 open and close apertures 31*a* and 32*a* leading to the airlocks 41 and 42 increasing or decreasing the flux of tobacco into system 10. For example, when more tobacco is demanded by the cigarette maker 80, the slide gate 31 opens allowing an increased volume of tobacco to enter into the airlock and subsequently conveyed pneumatically to the maker 80.

Vibratory feed pan 34 is connected to two maker hoppers 72 so that each bulker 29 feeds two separate cigarette manufacturing machines. In one preferred embodiment, the vibratory feed pan 34 has a dispensing capacity of about 40 pounds of tobacco per minute thereby feeding each of the makers connected to the feed pan 34 at a rate of about 20 pounds per minute. The corresponding flow rate of the tobacco is about 275 standard cubic feet per minute (SCFM) at the rotary air lock 41 or 42 with a comparable flow rate at the maker 80 of about 4000 to 4500 SCFM. The pneumatic piping 12 at these points has a diameter of about 3 inches.

Figure 5:
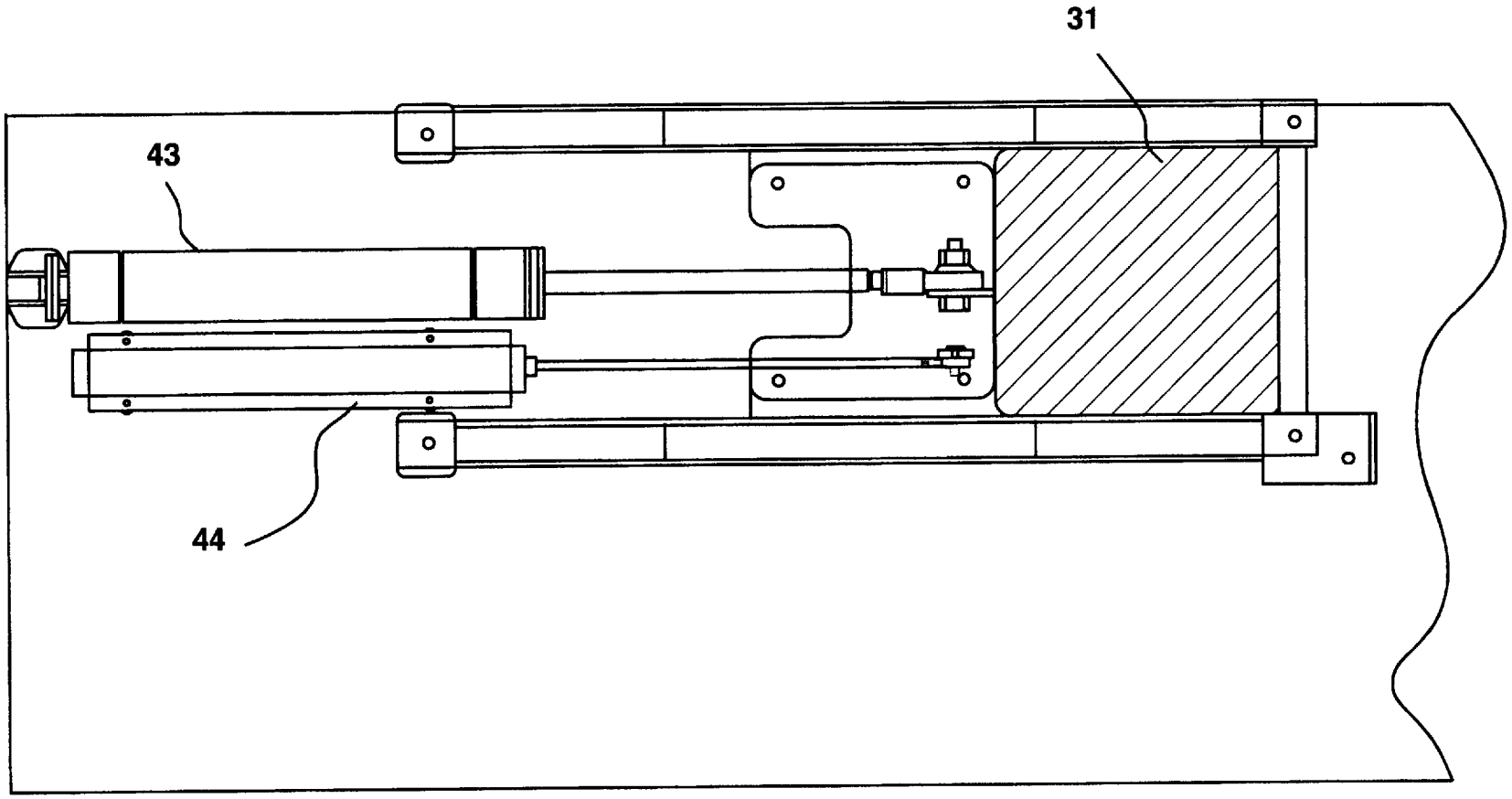
FIG. 5 is a bottom section view of a selected portion of the feed section shown in FIG. 3.

As shown in FIG. 3, the vibratory feed pan 34 is beveled in half with a half portion of the sloped surface 35 feeding one aperture 31*a* and the sloped surface 36 feeding aperture 32*a*. Tobacco cascades downward from the bulker 29 by the action of the dofflers 39 and conveyor belt 38 in an even fashion dispensing the tobacco across the entire width of the feed pan 34. Slide gate 31, shown in FIG. 5, is operably connected to air cylinder 43 which has a rectilinear transducer 44 measuring the position of air cylinder 43 and sending its corresponding position to a programmable logic controller (PLC) 102 which controls the closed loop system containing level transmitter 75 at the maker 80 and the slide gate 31 at the bulker 29. Slide gate 31 opens and closes aperture 31*a* feeding the airlock 41 thereby controlling the amount of tobacco allowed into the pneumatic conveyance piping 12 keeping the tobacco therein flowing at a constant rate and velocity. The action of slide gate 31 or 32 is directly controlled by the level transmitter 75 in the maker hopper 72. The maker hopper 72 of the present invention allows tobacco to enter into the cigarette maker 80 continually. An ultrasonic level transmitter 75 located at the maker hopper 72 determines the actual level of tobacco in the cigarette maker 80 itself. A predetermined optimal level in the cigarette maker 80 programmed into PLC 102. Level transmitter 75 continually measures the level of tobacco in the maker 80 and controls slide gate 31 in response to said measurements. If additional tobacco is required, slide gate 31 is opened more fully. If cigarette maker 80 is full of tobacco, slide gate 31 is closed. The measurement of tobacco in the cigarette maker 80 is determined such that upon complete closing of the slide gate 31, the surge of tobacco left in the pneumatic piping 12 will fill the remaining portion of the maker hopper 72.

The programmable logic controller 102 receives as input slide gate 31 and 32 positions as well as other data which is relevant to the continuous flow of tobacco in the pneumatic conveyance piping 12. As shown in FIG. 1, a flow transmitter 45 is located in the pneumatic piping 12 upstream of the vibratory feed pan 34 in order to measure the flow of the air in the piping 12. An additional flow transmitter 53 is located downstream of the aspirator cyclone 52 to again measure the velocity of the air after it reaches the separating section 50. A modulating flow control valve 51 connects the pneumatic piping 12 to a vacuum source in order to control the pressure and velocity through the conveying system 10. Actuation of the flow control valve 51 is in response to a programmable logic controller 100 which calculates the appropriate setting of the valve 51 based upon the measurements of the flow transmitters 53 and 45 optimally keeping the tobacco flowing continuously and at a constant velocity. Flow control valve 51 is a standard actuatable valve such as a Fisher V Ball flow control valve. As previously indicated, another PLC 102 also controls the air cylinder 43 which allows entry of the tobacco into rotary airlock 41 via slide gate 31. Only one air cylinder is shown for simplicity but both slide gates 31 and 32 are actuated similarly. In this way, a PLC 102 automatically controls the rate of tobacco which is fed into the pneumatic conveyance system and PLC 100 retains automatic control of the velocity of the tobacco which is being pneumatically conveyed. PLC 102 receives as input the output from a level transmitter which is located at the maker hopper 72. The level transmitter ultrasonically detects the level of tobacco within hopper 72 and determines the rate which the maker 80 is using tobacco. The continuous tobacco conveyance system thus automatically compensates the velocity of the tobacco within the conveyance piping 12 and also automatically compensates the airflow or vacuum required to move the tobacco varying distances from the bulker 29 to the maker 80. The system will adjust based upon contemporaneous readings of the present status of the system and adjust the airflow and amount of tobacco within the system, regardless of the number of makers demanding tobacco from the hopper in order to keep the flow continuous and at a constant velocity preventing damage to the tobacco which can occur during transport.

Figure 9:
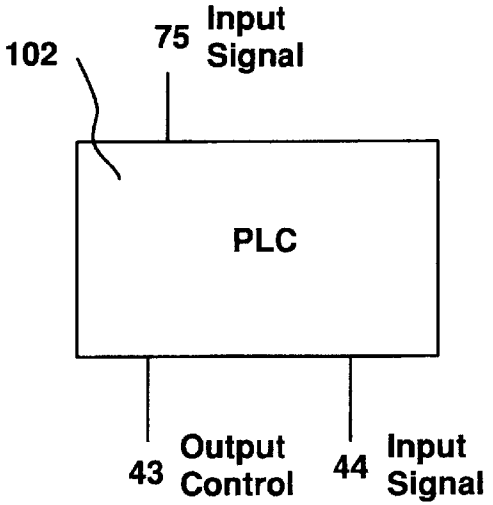
FIG. 9 is a schematic drawing of the programmable logic controller which automatically controls the feed rate of tobacco into the pneumatic conveyance piping.
Figure 8:
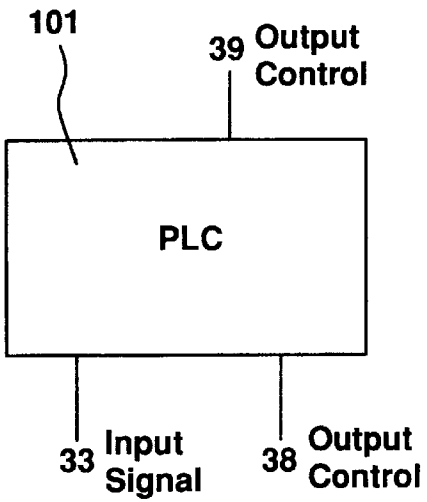
FIG. 8 is a schematic drawing of the programmable logic controller which automatically controls the dump rate of tobacco from the bulker to the vibratory feed pan.
Figure 7:
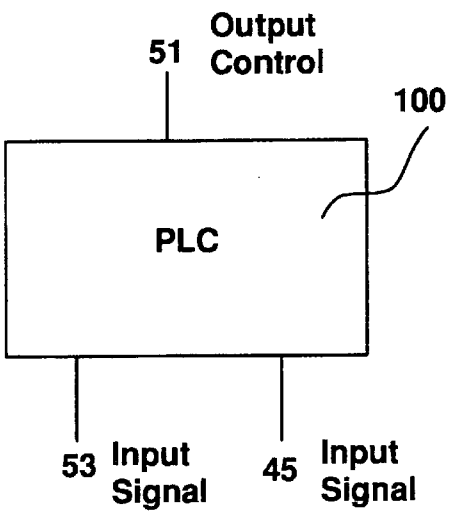
FIG. 7 is a schematic drawing of the programmable logic controller which automatically controls the velocity of air within the pneumatic system.

There are three independent closed control loops which are monitored and reacted to by the PLC's 100, 101 and 102, these are shown schematically in FIGS. 7, 8 and 9. The first 101 is utilized to control the dump rate of tobacco into pan 34 using the conveying belt 38 and dofflers 39 according to measurements of the ultrasonic level transmitter 33 at the vibratory feed pan 34. This PLC 101 takes as input the measurement of the level of tobacco in the vibratory feed pan 34 and actuates belt 38 and dofflers 39 accordingly. The second PLC 100 controls the velocity rate of the air within the pneumatic conveyance piping 12 and therefore the velocity of the tobacco itself. PLC 100 receives as input measurements from flow transmitters 45 and 53 for actuating flow control valve 51. This control ensures a constant velocity of the air within the conveyance system. Flow control valve 51 is directly connected to a vacuum source and may provide low levels of pressure in order to move large volumes of tobacco. Finally, PLC 102 controls the feed rate of tobacco into the maker hopper and receives as input measurements from the ultrasonic level transmitter 75 in the maker, PLC 102 being operatively connected to the slide gate 31 thereby controlling the input of the tobacco into the airlock 41. This in turn limits the volume of tobacco in the pneumatic piping 12. These three independent controllers 100, 101, 102 control the amount of tobacco transported and the velocity of the tobacco contained within the piping 12. The system 10 is also calibrated such that upon high levels of tobacco measured at the maker 80, slide gate 31 is closed preventing the deleterious occurrence of shutting off vacuum in the piping 12 allowing the tobacco to fall in place. Reinstituting the vacuum source after such an occurrence damages the tobacco and increases dusting thereof. Therefore, the present system determines the surge of tobacco remaining in the piping 12 after gate 31 is closed to ensure all of the tobacco can fill the remaining portion of maker 80 and hopper 72.

Figure 6:
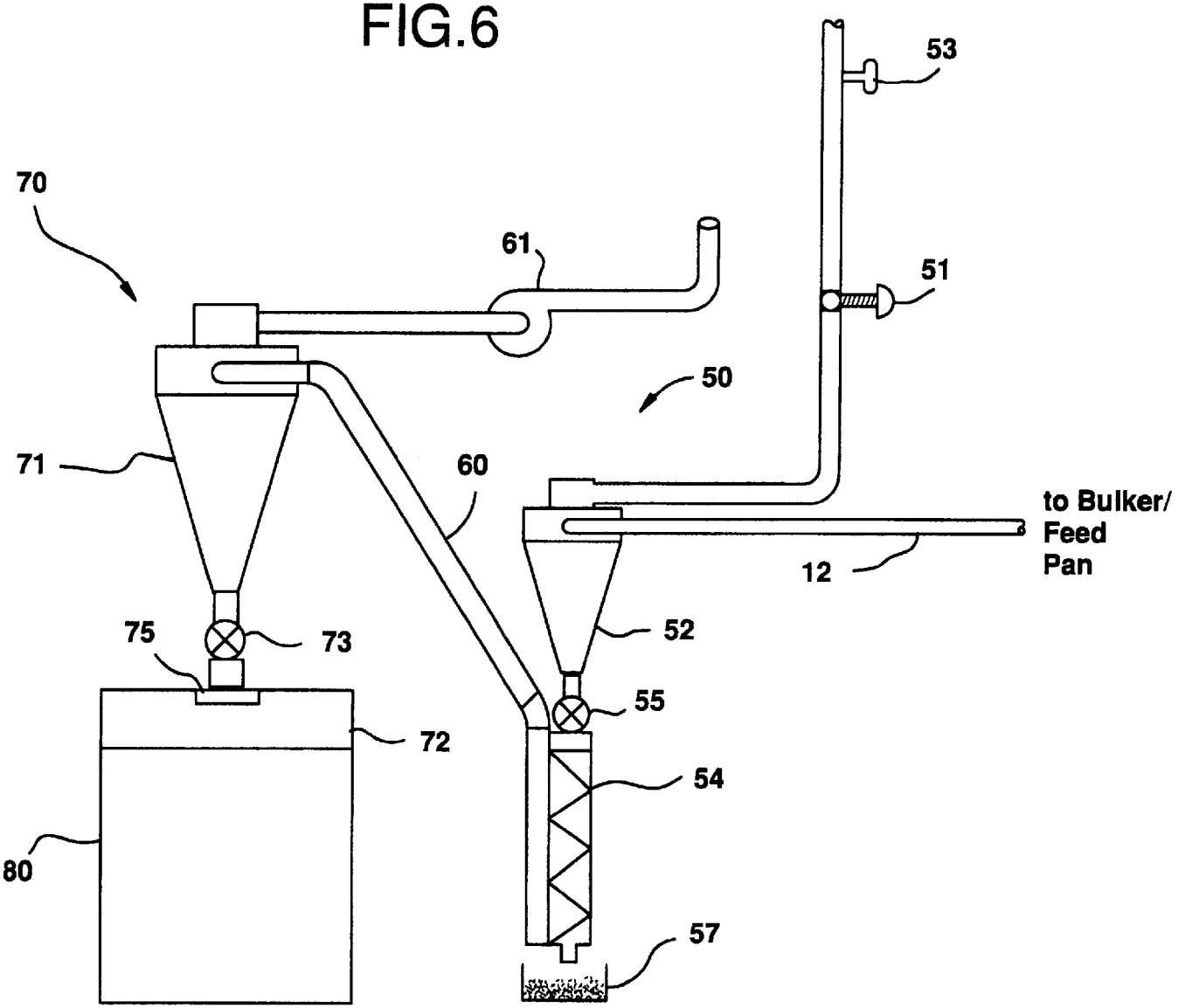
FIG. 6 is an enlarged plan view of a separation section and a cigarette making section shown in FIG. 1.

As shown in FIG. 6, the separation section 50 is comprised of a cyclone 52 and aspirator 54. The cyclone 52 reduces the velocity of the tobacco and separates the tobacco from the airflow allowing the tobacco to fall out of the airstream and into the rotary airlock 55 thereby preventing loss of pressure within the closed loop pneumatic conveyance piping 12. Rotary airlock 55 delivers the tobacco from the cyclone 52 to a four pass multi-aspirator 54 for separation of the stems, bulbs, winnows and other heavier portions of the tobacco from the lamina which is utilized in the cigarette manufacturing machine 80. The stems, bulbs and winnows are deposited into a storage receptacle for later use in reconstituted tobacco or other products.

After separation of the heavier materials from the lamina at the four pass multi-aspirator 54, the tobacco material is passed to the maker cyclone 71 through conduit 60 which has, enclosed therein, sufficient vacuum pressure created by blower 61 to move the material to the maker cyclone 71. The tobacco material is deposited into the maker cyclone 71 where it is separated from the airflow and passed through an additional rotary airlock 73. Rotary airlock 73 deposits the conveyed tobacco material into the maker hopper 72 which is continually monitored by an ultrasonic level transmitter 75 and which feeds tobacco directly into the cigarette maker 80. The hopper 72, as used herein, is the intake reservoir portion of the cigarette maker 80 and is therefore integral therewith. Tobacco is dropped from the rotary airlock 73 through the upper maker hopper 72 and into the cigarette maker 80 itself. Level transmitter 75 is an ultrasonic emitter detector which determines the current level of tobacco in the maker hopper 72 and relays that information to the PLC 102. The level transmitter 75 in the maker hopper 72 relays a request for more tobacco to the PLC 102 and additional tobacco is conveyed from the bulker 29 to the maker 80 via opening of slide gate 31 as required.

During operation, the level transmitter 75 at the maker 80 determines when a high level of tobacco is obtained therein. At such point, a high level signal is sent to the PLC 102 and tobacco is prevented from entering the pneumatic piping 12 by closure of the slide gate 31 feeding the airlock. The remaining surge of tobacco within the piping system 12 is calculated so that the maker 80 is not overfilled. The vacuum source for the pneumatic piping 12 remains on continuously preventing the occurrence of tobacco remaining in the piping 12 when the source is shut off as is done in prior art systems. Flow or volume of tobacco is fully controlled by the actuation of the slide gate 31 and not the vacuum source thereby increasing the efficiency of the system and decreasing the damage to the tobacco itself. Thus, PLC 102 calculates the amount of tobacco within the pneumatic piping 12 and the amount of tobacco required to fill the maker hopper 72 to its ideal fill value as detected by the level transmitter 75 to ensure that tobacco is continuously transported to the maker hopper 72. This prevents damage to the tobacco upon removal of the vacuum source and startup when additional tobacco is requested by the maker 80. Of particular concern during the operation of pneumatic conveyance systems is dust generation which is a good indication of the continuous handling of the tobacco in the conveyance system. Typically, dust generation from pneumatic conveyance handling systems for tobacco is around 2%. The present invention can reduce the amount of dust generation less than ½%.

Figure 10:
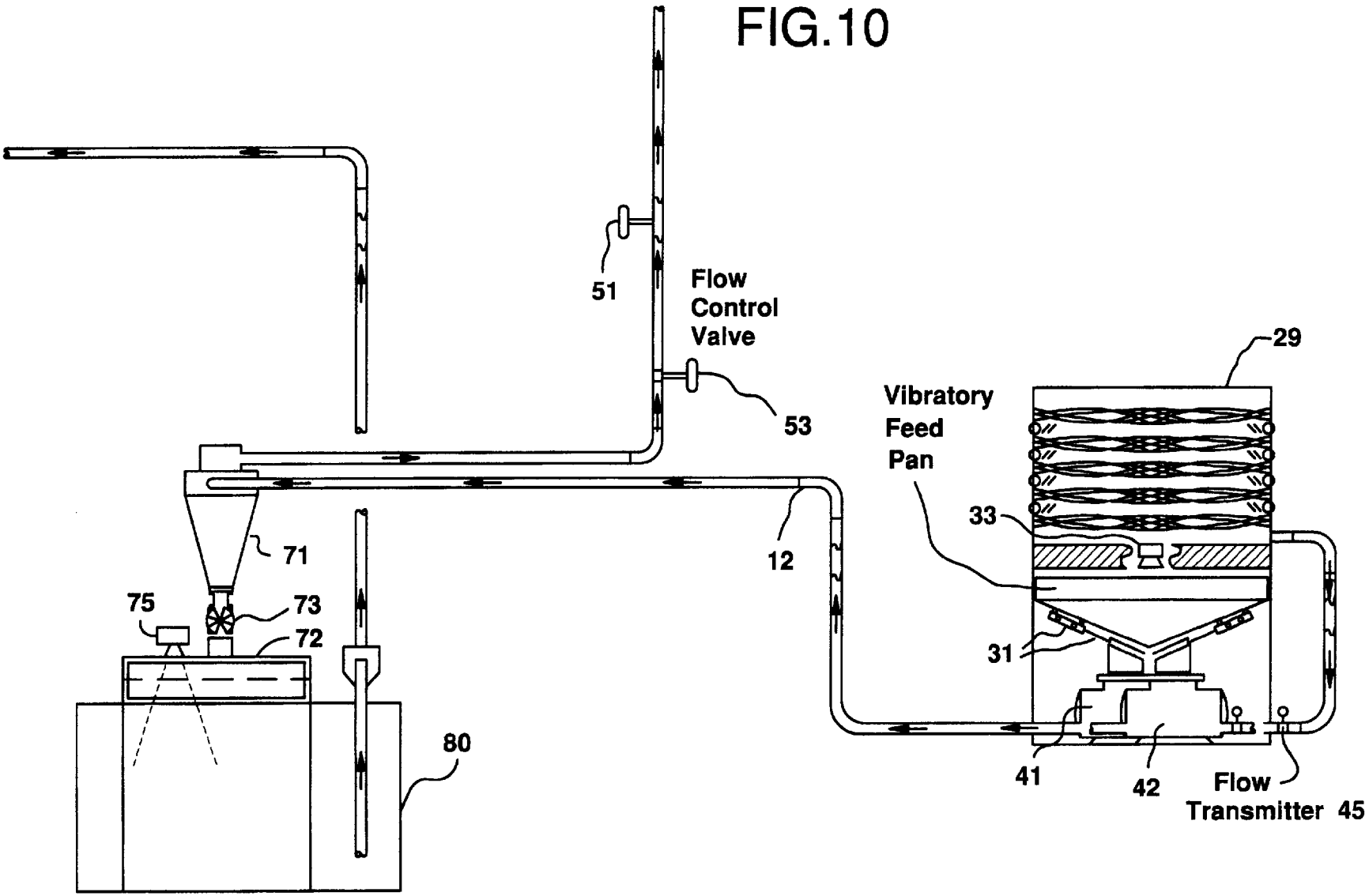
FIG. 10 is a plan view of an alternative embodiment of a continuous pneumatic conveyance system for tobacco without an aspirator.

An alternative embodiment is shown in FIG. 10 wherein the aspirator 54 and aspirator cyclone 52 is removed from the system. In this embodiment, pneumatic piping is in flow communication directly with the maker cyclone 71. Cyclone 71 is connected to a rotary airlock 73 which allows tobacco removed from the high velocity airstream to be placed into the maker 80 through the maker hopper 72. Again, a ultrasonic level transmitter 75 is utilized to control the slide gate 31. This embodiment removes the requirement of having an aspirator and associated cyclone. Stems, bulbs and other heavy material within the tobacco flow are removed from the system by the makers 80 winnowing system.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. An apparatus for continuously feeding tobacco from a bulker to at least one cigarette making machine, comprising:

a vibratory feed pan affixed to said bulker and disposed beneath a discharge opening of said bulker, said vibratory feed pan having an outlet, said outlet having at least one aperture and a slide gate slidably mounted over said aperture;

a first rotary airlock for dispensing said tobacco to pneumatic piping disposed below said slide gate;

a first cyclone connected to said at least one cigarette making machine;

said pneumatic piping connecting said airlock to said cyclone and further connecting said cyclone to a vacuum source;

a first ultrasonic level transmitter within said cigarette making machine for measuring the level of said tobacco in said cigarette making machine; and, a first controller for controlling the entry of said tobacco into said pneumatic piping and operably connected to said level transmitter and said slide gate.

2. The apparatus of claim 1 further comprising:

a first flow transmitter in said pneumatic piping between said cyclone and said vacuum source for measuring the velocity of air within said piping;

a flow control valve located within said pneumatic piping between said cyclone and said vacuum source;

a second controller operably connected to said flow control valve and said first flow transmitter for controlling the velocity of air within said piping.

3. The apparatus of claim 2 further comprising a second flow transmitter located in said piping preceding said airlock, said second flow transmitter operably connected to said controller.

4. The apparatus of claim 1 wherein said bulker further comprises:

a plurality of doffler bars and a belt conveyor at one end of said bulker;

a second ultrasonic level transmitter affixed above said vibratory feed pan; and, a second controller operably connected to said plurality of doffler bars, said belt conveyor and said second level transmitter for controlling the dispensing of tobacco onto said vibratory feed pan.

5. The apparatus of 1 wherein said vibratory feed pan is of V-shaped cross-section having a first and second downward sloped surface.

6. The apparatus of claim 1 further comprising a second rotary airlock between said cyclone and said at least one cigarette making machine.

7. The apparatus of claim 1 further comprising:

a four pass multi-aspirator between said first airlock and said first cyclone, said aspirator having a second cyclone directly therebefore, said second cyclone depositing tobacco into said aspirator; and wherein said second cyclone is in flow communication with said vacuum source.

8. The apparatus of claim 7 further comprising a second rotary airlock between said second cyclone and said aspirator.

9. The apparatus of claim 1 wherein said tobacco is fed into said first airlock at a rate of about 20 pounds per minute.

10. The apparatus of claim 1 wherein the flow rate of air at said first airlock is about 275 standard cubic feet per minute.

11. The apparatus of claim 10 wherein said pneumatic piping is about 5 inches in diameter.

12. The apparatus of claim 1 wherein said slide gate is operably connected to an air cylinder.

13. The apparatus of claim 12 further comprising a rectilinear transducer operably connected to said slide gate.

14. An apparatus for continuously feeding tobacco from a bulker to two cigarette making machines, comprising:

means to deposit said tobacco from said bulker into a vibratory feed pan having a first and a second tobacco discharge aperture therein, said first aperture slidably coverable by a first slide gate and said second aperture slidably coverable by a second slide gate;

a first airlock disposed below said first aperture and a second airlock disposed below said second aperture;

a first and a second cigarette making machine;

pneumatic piping connecting said first airlock to said first cigarette making machine and said second airlock to said second cigarette making machine, said pneumatic piping being further connected to a vacuum source;

means for detecting the level of tobacco within each of said machines; and, first controller means for dispensing said tobacco into said pneumatic piping operably connected to said detecting means and to said first and second slide gates.

15. The apparatus of claim 14 further comprising a first cyclone connected to said first cigarette machine and in flow communication with said first airlock and a second cyclone connected to said second cigarette machine and in flow communication with said second airlock.

16. The apparatus of claim 14 wherein said means to deposit tobacco from said bulker comprises:

a plurality of doffler bars and a belt conveyor at one end of said bulker;

an ultrasonic level transmitter affixed above said vibratory feed pan;

a second controller operably connected to said plurality of doffler bars, said belt conveyor and said level transmitter.

17. The apparatus of claim 14 further comprising:

means to detect the velocity of air within said pneumatic piping;

a flow control valve within said pneumatic piping; and, a third controller operably connected to said detection means and said flow control valve.

18. The apparatus of claim 17 wherein said detection means comprises a flow transmitter inserted within said pneumatic piping.

19. A method of continuously conveying tobacco from a bulker to a cigarette manufacturing machine, comprising:

dispensing tobacco from said bulker into a feed pan;

discharging tobacco from said feed pan into an airlock, said discharging being operable in response to a pre-selected tobacco level in said cigarette maker;

continuously pneumatically conveying tobacco within piping from said airlock to said cigarette making machine;

controlling the flow of tobacco within said piping by measuring the velocity of airflow in said piping by opening and closing a flow control valve in response to said measuring.

20. The method of claim 19 wherein an ultrasonic level transmitter measures the level of tobacco in said maker.

21. The method of claim 19 wherein said dispensing tobacco into said feed pan further comprises:

measuring the depth of tobacco in said feed pan by an ultrasonic level transmitter; and, activating a conveying belt in said bulker in response to said measurements of said level transmitter to deposit said tobacco onto said feed pan.

22. The method of claim 19 wherein said discharging tobacco from said feed pan further comprises:

opening and closing a slide gate in response to said measuring by said level transmitter;

allowing tobacco to fall from said feed pan into said piping in response to said opening and closing of said slide gate;

wherein said slide gate operably covers an outlet aperture to said airlock.

* * * * *